United States Patent [19]

Ross et al.

[11] Patent Number: 4,685,375

[45] Date of Patent: Aug. 11, 1987

[54] MIX-DELIVERY SYSTEM FOR EXPLOSIVES

[75] Inventors: Cyrus A. Ross; Eberhard Thurow, both of Kirkland Lake, Canada

[73] Assignee: Les Explosifs Nordex Ltee/Nordex Explosives Ltd., Kirkland Lake, Canada

[21] Appl. No.: 868,763

[22] Filed: May 28, 1986

Related U.S. Application Data

[63] Continuation of Ser. No. 610,310, May 14, 1984, Pat. No. 4,614,146.

[51] Int. Cl.[4] ..... F42B 3/00

[52] U.S. Cl. ..... 86/20.15; 86/20.12; 149/2; 149/60; 149/109.6; 264/3.4

[58] Field of Search ..... 86/20 R, 20 C, 20 D, 86/20.1, 20.12, 20.15; 149/2, 41, 43, 44, 46, 60, 109.6; 264/3.1, 3.4, 3.6

[56] References Cited

U.S. PATENT DOCUMENTS

| | | | |
|---|---|---|---|
| 3,886,010 | 5/1975 | Thornley et al. | 149/43 X |
| 4,142,928 | 3/1979 | Stewart | 264/3.6 X |
| 4,216,040 | 8/1980 | Sudweeks et al. | 149/43 X |
| 4,388,254 | 6/1983 | Maes et al. | 264/3.4 |
| 4,439,254 | 3/1984 | Mullay | 149/43 X |
| 4,585,495 | 4/1986 | Honeyman et al. | 149/2 |

*Primary Examiner*—Peter A. Nelson
*Attorney, Agent, or Firm*—Sim & McBurney

[57] ABSTRACT

Method and apparatus for making aqueous slurry explosives are disclosed. The components of the aqueous slurry explosive are mixed in a variable speed rotary mixer where the speed of the mixer is determined by the sequence of addition of the explosive components. The explosive components generally comprise water; an inorganic oxidizing salt such as ammonium nitrate; organic liquid such as propylene glycol; organic solids such as sugar; air entraining agents such as microspheres; densifying agents such as hot ammonium nitrate solutions; thickening agents such as flours and guar gums and pH adjustors and self-explosives. The aqueous slurry explosive may be formed using ambient temperature water. The apparatus is particularly suited as a mobile unit for use in the field.

3 Claims, 1 Drawing Figure

MIX-DELIVERY SYSTEM FOR EXPLOSIVES

This is a continuation of application Ser. No. 610,310, filed May 14, 1984 now U.S. Pat. No. 4,614,146.

FIELD OF THE INVENTION

This invention relates to aqueous slurry explosive mixtures and method and apparatus for their manufacture.

BACKGROUND OF THE INVENTION

Traditionally explosives have been prepared on site with metered flow provided by various augers, vibrators and mixers feeding into pumps for delivery to blast holes in the material to be blasted. Uneven terrain, exposure to climate and lack of quality control testing has normally resulted in poor blasting results. Other methods using large concrete mixers require handling of extreme weights and are subject to differential segregation which provides poor repeatability in blasting. To improve on quality control, fixed plants using rigid quality control have been tried where the final product is shipped to the field in large containers and a pump is used to discharge the mixture for use. This system provides initially a better product but transportation over rough roads may result in segregation of the ingredients.

Aqueous slurry blasting compositions have been prepared in a variety of forms with a view to improving their reliability and stability in the field. U.S. Pat. No. 3,390,030 discloses an aqueous slurry blasting composition which employs the use of an aeration agent to lower the specific gravity of the composition and thereby improve its sensitivity. The aeration agent is in the form of a sodium nitrite or sodium bicarbonate which lowers the specific gravity of the aqueous slurry blasting agent at the time of blasting. The ammonium and sodium nitrates, as used in the blasting composition, are dissolved in a hot solution at approximately 140° F., thus requiring the preparation of the composition in a plant operation. The aqueous slurry also involves the use of ethylene glycol and guar gum as the thickener. The non-explosive carbonaceous fuel is ground coal, although it is suggested that other carbonaceous fuels such as glycols, amine nitrates and granulated sugar may be used.

The use of aluminum as a sensitizer agent in ammonium nitrate explosives has become quite popular, as also exemplified in this patent. The flaked aluminum entraps air on its surfaces assisting in inclusion of tiny air bubbles in the slurry. Such bubbles in an explosive serve to provide "hot spots" which help initiate the compositions.

Canadian Pat. No. 804,540 discloses an aerated aqueous slurry explosive composition using an inorganic oxidizing salt such as ammonium nitrate. Incorporating approximately 1% by weight of surfactant provides air entrainment within the composition. The air entrainment efficiency of the composition significantly improves the sensitivity of the composition to detonation by the high explosive pentaerythritol tetranitrate (PETN) boosters or the like. The slurry composition includes ammonium and sodium nitrate as the inorganic oxidizing agent. Pine oil, ethylene glycol and guar gum are used as thickening agents in combination with sugar and flaked aluminum.

Many other forms of explosive compositions have been prepared and tried as exemplified in Canadian Pat. No. 610,246 which is directed to a basic ammonium nitrate explosive composition, where carbon is used as the sensitizer for the inorganic oxidizing agent. Canadian Pat. No. 657,242 discloses the use of a heated solution in combining the ammonium nitrate into the explosive composition. Canadian Pat. No. 657,934 requires the use of a finely divided ammonium nitrate with a liquifiable carbon such as fuel oil. Canadian Pat. No. 713,491 uses a surfactant in combination with nitric acid where the fuel material is essentially unreactive with the nitric acid component to provide a stable composition. Canadian Pat. No. 829,230 discloses the use of hexamethylene triamine sensitizers for an ammonium nitrate explosive composition.

With the explosive compositions disclosed in these patents, no attention has been directed to the mixing technique and as experience in the marketplace, these compositions are routinely mixed in various forms of rotating blade mixers and stirrers which are operated at a constant speed of mixing.

The method, apparatus and aqueous slurry explosive mixture in accordance with this invention provides a composition which has improved performance, is economical to manufacture and the apparatus is particularly compact lending itself for use as a mobile unit.

SUMMARY OF THE INVENTION

According to an aspect of the invention, the method for preparing the explosive composition comprises mixing at a first speed in the mixer 10 to 20 parts by weight of ambient temperature water with 3 to 12 parts by weight of sugar and optionally up to 5 parts by weight of an air bubble entraining agent other than paint fine aluminum. Mixing is continued at this first speed and 50 to 85 parts by weight of ground ammonium nitrate is added. After addition the mixing speed is increased to a second speed in forming a saturated solution of ammonium nitrate. At this second speed, up to 5 parts by weight of paint fine aluminum in a plastic mesh binding may be added. A dispersion of 0.1 to 4 parts by weight of guar gums and 2 to 6 parts by weight of ethylene glycol is added and mixing continued at the second speed. The mixing speed is reduced to the first speed when complete distribution of the components is achieved and mixing is continued at the first speed until the guar gum content is completely hydrated.

BRIEF DESCRIPTION OF DRAWINGS

Preferred embodiments of the invention are shown in the drawings wherein.

DETAILED DESCRIPTION OF THE PREFERRED EMBODIMENTS

Figure 1:
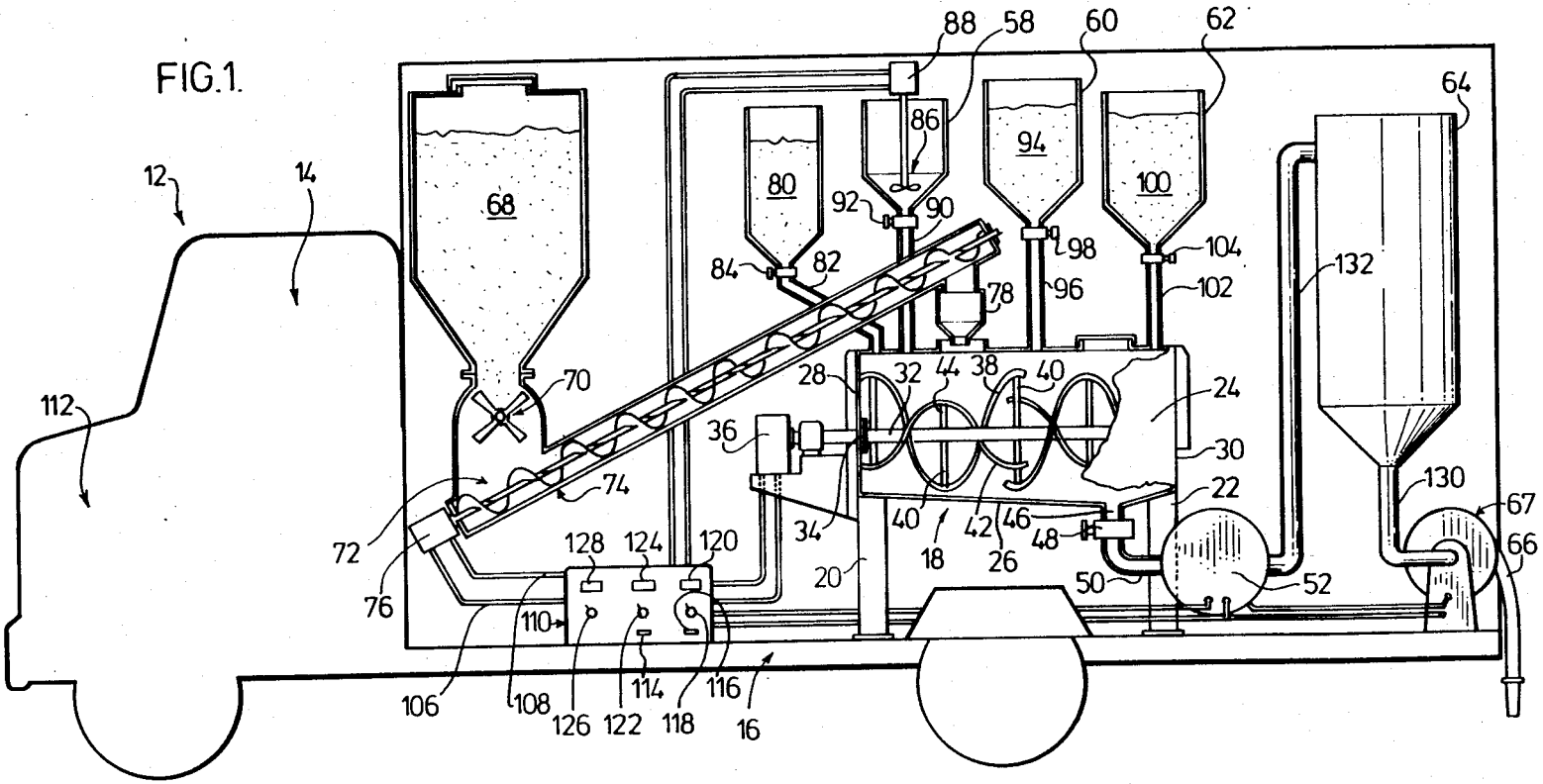
FIG. 1 is a schematic of the apparatus according to this invention adapted for use as a mobile unit.

The apparatus, according to this invention, is adapted for use in mixing small batches of up to 5,000 pounds of aqueous slurry explosive mixtures. The batches are of a size such that, when mixed by the apparatus of this invention, a homogeneous consistent explosive mixture with reliable performance is produced. The apparatus 10, as shown in FIG. 1, is adapted for use on a mobile unit 12 having truck cab 14 and flat bed 16. The apparatus 10 is secured to the flat bed 16 where the rotary mixer 18 is supported on the flat bed 16 by posts 20 and 22. The mixer 18, according to this preferred embodiment, is a double ribbon rotary mixer having a tank 24 which is semi-circular in cross-section along its bottom 26. According to an embodiment of the invention, the tank 24 may be cylindrical where the end walls 28 and 30 are upright and planar. The shaft 32 for the mixer is bearingly mounted in the walls by bearings 34 where the shaft extends outwardly of end wall 28 to be driven by motor 36. Secured to the shaft is an outer helical ribbon bar 38 which is connected to the shaft by radial arms 40. The outer helical ribbon bar extends along and is symmetrical about the shaft. Similarly, an inner ribbon bar 42 is secured to the shaft by shorter arms 44 and extends along and is symmetrical about the shaft. The outer helical ribbon bar 38 extends along the tank in a first rotational direction and the inner helical ribbon bar 42 extends along the tank in a second rotational direction opposite to that of the first rotational direction. This arrangement for the double ribbon mixer bars induces a forward and a reverse flow to the mixture in providing continuous shear blending of the mixture components. According to a preferred embodiment of this invention, there are two sets of the inner and outer helical ribbon bars in the double ribbon mixer blender 18. It is appreciated that other types of mixers may be used with the variable speed feature of this invention for mixer explosives. Other types of mixers include blade type and paddle type.

Preferably the bottom portion 26 of the mixer tank 24 is sloped towards the outlet 46 which has a control valve 48 for passage of the mix components via conduit 50 to pump 52. It is appreciated that other forms of rotary mixers may be used, such as rotary paddle mixers, blade mixers and the like. The important aspect of these mixers is that they have variable speed facility.

The components for the aqueous slurry explosive mixture are stored in storage tanks 54, 56, 58, 60 and 62. The mixed product, when taken off the mixing tank 24, is pumped by pump 52 into the slurry explosive mixture storage tank 64. It is appreciated that the storage tank 64 is optional in that the mixture when taken off the mixing tank 24 may be pumped directly via hose 66 into the bore holes.

Storage tank 54 stores the ammomium nitrate 68 which is ground by a stainless steel hammer mill 70. The ground material falls onto the base 72 of auger 74 which is driven by hydraulic motor 76. The ground ammomium nitrate is augered up to inlet 78 for introduction to within the mixing tank 24. The microspheres 80 are stored in tank 56 and a quantity thereof is introduced to the mixing tank 24 via conduit 82 as controlled by valve 84. Storage tank 58 is for the thickening agents which may be guar gum and ethylene glycol. These components are mixed by stirrer 86 which is driven by hydraulic motor 88. The mixed thickening agents are introduced to the mixing tank via conduit 90 as controlled by valve 92.

Storage tank 60 may be used as the water metering tank containing ambient temperature water 94. A site glass may be provided on the side of the tank to indicate the quantity of water being dispensed via conduit 96 into the mixing tank as controlled by control valve 98. The storage tank 62 may be used to store the batch weight of sugar 100 which is dispensed via conduit 102 into the mixing tank as controlled by control valve 104.

In addition to hydraulic motors 36, 76, 88, hydraulic motors are also provided for driving pump 52 and a pump (not shown) in the hose reel 67. For each hydraulic motor is a set of lines such as 106 and 108 for hydraulic motor 76. A control device 110 is provided for controlling the flow of pressurized hydraulic fluid in the lines 106, 108 to the various motors. The pressurized hydraulic fluid may be provided to the controller 110 by way of a hydraulic pump mounted on a power take off from the engine compartment 112 of the mobile unit. By way of a manifold arrangement, the pressurized fluid may be distributed to the various lines 106, 108 for each of the hydraulic motors as determined by the controller 110. Switches 114 and 116 are provided for the motors on pump 52 and the pump within the hose reel 67. Since these pumps are not of variable speed, simple on/off switches are all that is required. For hydraulic motor 36, rotary valve 118 is provided to control the flow rate of the hydraulic fluid in the lines 106, 108 to motor 36, where by calibration the speed at which the shaft 32 is turning is read out on meter 120. Similarly, control valve 122 in combination with meter 124 determines and indicates the speed of the motor 88 for the stirrer 86. The hydraulic motor 76 is controlled by variable control valve 126 where its speed is indicated on meter 128.

In accordance with the sequence of additions of the various components for the explosive mixture, the speed at which the rotary mixer 18 is driven is determined by the control valve 118, the details of which will be explained with respect to Examples demonstrating the mixing of preferred compositions. The controller 110 is set up to provide a range of mixing speeds in the rotary mixer varying from approximately 20 rpm to approximately 100 rpm.

It is appreciated that in the pumping arrangement to economize on the number of pumps used in handling the slurried explosive, the conduit and valving arrangement may be modified so that pump 52 may be used to not only transfer the mixed slurry composition into storage tank 64, but also be used to withdraw the explosive mixture from the tank 64 via outlet conduit 130 and pump it through the hose 66 thereby eliminating the pump and the hose reel 67. This may be accomplished by rerouting conduit 130 to the inlet 50 of pump 52 and providing a T-section on the outlet of pump 52 where, in addition to conduit 132 which transfers the mixed slurry to the storage tank 64, there is a second conduit which is interconnected to the hose reel 67.

The apparatus, according to this invention, is useful in preparing many forms of aqueous slurry explosive mixtures. In general, the apparatus according to this invention may be used to mix explosive mixtures which have the following composition:

(i) 8% to 25by weight water;

(ii) 50% to 85% by weight of an inorganic oxidizing salt selected from the group consisting of ammonium nitrate, alkali metal and alkaline earth metal nitrates and perchlorates, ammonium perchlorate and mixtures thereof;

(iii) 2% to 10% by weight of an organic liquid selected from the group consisting of ethylene glycol, propylene glycol, diethylene glycol, formamide, fuel oil, mineral oils and their emulsions and mixtures thereof, (iv) 3% to 15% by weight of an organic solid selected from the group consisting of sugar, hexamine, finely ground coal, sawdust, and pine needles and mixtures thereof, (v) 0% to 6% by weight of air entraining agents selected from the group consisting of glass, Saran (trademark) or borate microspheres, perlite, vermiculite, paint grade aluminum, milled aluminum, silicon, ferrosilicone, frothing agents and mixtures thereof, (vi) 0% to 25% by weight of densifying agents selected from the group consisting of barite, magnetite, hot ammonium nitrate solutions and mixtures thereof, (vii) 1% to 4% by weight of thickening agents selected from the group consisting of flours, gums and mixtures thereof, (viii) 0% to 25% by weight of ancillary components selected from the group consisting of catalysts, pH adjusters and a self-explosive.

This product may be either packaged for later loading or pumped in bulk form down blast holes. Conventional priming devices, such as blasting caps, cast primers or detonating cord, may be used to initiate these products with exceptional and reproducable results. The priming devices may be of the well known variety used, such as PETN (pentaerythritol tetranitrate), TNT, RDX (cyclotrimethylenetrinitraamine), Tetryl or the like.

The inorganic oxidizing component includes nitrate fertilizers in prill form, particulated form and in solution. These nitrate fertilizer mixtures may include ammonium nitrate, sodium nitrate, calcium nitrate, and other metal nitrates. Also perchlorates or permanganates of ammonia. The blending of the ammonium nitrates and the like in the slurry composition is conducted with cold water, that is water at ambient temperature. There is no need to heat the water used in the system in forming the saturated solution for the ammonium nitrate mixture. Normally the water is at 40° F. and thereby forming a saturated solution at this temperature, where normally the temperature does not exceed this level. In so doing, we do not form crystals in the slurry as compared to systems which may use hot water in dissolving the ammonium nitrate which upon cooling can form growth masses of insensitive ammonium nitrate crystals, thereby affecting the reproducibility of the blasting power of the composition.

Various fuels are used which may include glycol, sugar, carbon commuted to −30 mesh, fuel oil, hexamines and formamide. It is understood that the term sugar covers any form of suitable sugar substance, such as standard granular sucrose, dextrose and the like which can be used in an explosive mixture as a carbon source. Explosives may be used such as TNT, PETN, or fine grained smokeless powders. Metals such as aluminum, silicon, ferrosilicon; metal oxides such as barite or magnetite may be included as fuels or densifying agents. Emulsifiers may be required to suspend certain liquid fuels.

Since heat transfers within the explosive is assisted by adiabetic compression of the micro air bubbles, inclusion and distribution of these bubbles is preferable to ensure detonation with no self-explosive in the slurry composition. Suitable agents for incorporating micro air bubbles are frothers, such as Deriphat (trademark), micro balloons, such as made from Saran (trademark), glass or borates and low density metals which have been rolled to entrap air while being ground, such as certain aluminum powders commonly known as paint fine aluminum.

To provide long term storage in either package form or down the bore hole bulk form, guar gum is selected optionally containing suitable catalysts. The mixture is kept at suitable pH with appropriate buffering agents, such as ammonium hydroxide or nitric acid until the final point of use. A rapid pH change may be induced by ammonium gas solution, nitric acid mixtures or sodium dichromate solution. This creates a final product known as a gel which is water resistant and thus very useful in bore hole applications.

The apparatus 10, as used in mixing the slurry, may have premeasured amounts of each of the components for the mixture, so that the exact amount in each of the storage tanks 54, 56, 58, 60, and 62 are introduced to the mixing tank 24. In the alternative, where smaller batches of explosive are required, various types of metering and weighing devices (not shown) may be used so that the exact proportions of the mixture components can be introduced to the mixing tank 24 for mixing. It is appreciated, of course, that the mixing tank 24 will have upper and lower limits in terms of the amount for each batch to be mixed. Preferably in mobile units, the mixing tank 24 is of a size that will handle ranges in batch compositions of 500 to 5000 lbs.

An aqueous slurry explosive of the following composition range is made up as follows:

(i) 10% to 20% by weight of water, (ii) 3% to 13% by weight of sugar, (iii) 1% to 5% by weight of an air entraining agent selected from the group consisting of borate microspheres, glass microspheres, Saran microspheres and milled aluminum of 50 to 20 u particle size, (iv) 50% to 85% by weight of ammonium nitrate, (v) 2% to 6% by weight of ethylene glycol, (vi) 1% to 4% by weight of guar gums, (vii) 0% to 15% by weight of ground aluminum as a thermal energy additive.

Based on 100 parts by weight, the following specific composition was mixed: 13 parts by weight of water was introduced to the mixer, then 10 parts by weight of sugar and 2 parts by weight of Q-cells ( trademark) (microspheres of tiny hollow particles that encapsulate air in a spherical shell) were added to the mixer and blended completely for approximately 2 minutes at a speed of 40 rpm. Seventy-two parts by weight of crushed ammonium nitrate was added while blending at 40 rpm. When all ammonium nitrate was added, the mixer speed was increased to 80 rpm for 2 minutes.

One part by weight and 2 parts by weight of guar gums and glycol were mixed in the stirrer storage tank 58 and introduced to the mixer which continued mixing at 80 rpm. When complete distribution was achieved, the mixer speed was lowered to 40 rpm until the guar gums were completely hydrated. The composition was then ready for transfer to the bore holes or storage in the storage tank 64.

It has been found that the explosive composition is particularly inexpensive to manufacture and has a good explosive property. The following table compares the power of the above specific composition to known materials.

POWER OF SUGAR GEL

| Product | Weight Energy Kilocalories/Gram | Bulk Energy Kilocalories/cc | Density GMS/cc |
|---|---|---|---|
| ANFO (Ammonium Nitrate Fuel oil Explosive Mix) | 0.84 | 0.69 | 0.83 |
| Standard TNT Slurry | 0.7972 | 1.1161 | 1.40 |
| Specific Mix of this | 0.6298 | 0.7872 | 1.25 |

-continued

| POWER OF SUGAR GEL | | | |
|---|---|---|---|
| Product | Weight Energy Kilocalories/Gram | Bulk Energy Kilocalories/cc | Density GMS/cc |
| Invention | | | |

Production blasting confirmed that the product without aluminum additives compares favourably to ANFO on a bulk energy basis. As with all water gels, aluminum fuels may be used to add linearly to the power.

Fuel grade aluminum may be used in these compositions to provide higher strengths. Up to a level of approximately 15% by weight of aluminum may be used. The fuel grade aluminum is usually through −30 mesh and retained on a +100 mesh screen. The paint fine aluminum in a Teflon mesh is added to the mixture at the higher mixer speed of 80 rpm. This higher speed properly dispenses the aluminum fines throughout the mixture.

The variable speed rotary mixer is particularly useful in blending the microspheres without breakage. Equal utility is found in dispensing paint fine aluminum which has the "Teflon" (trade mark of Dupont for a fluorocarbon resin) mesh bonding the aluminum fines. This does not disperse properly during normal mixing. However in using the double ribbon blender at variable speeds, the desired mixing is achieved in forming a uniform dispersion of the aluminum fines through the mix without wetting the aluminum and thereby driving off the micro air bubbles trapped on the aluminum fines during milling. Because of the efficiency of the mixer, a compact arrangement is provided for the apparatus which lends itself readily for use on mobile units. Thus the unit may be driven to the field with the components unmixed, thereby avoiding segregation of premixed components. The system may then prepare the desired amount of explosive composition for dispersal through the hose 66 to the various bore holes in the material to be blasted. Also because of its compactness, the apparatus may be used in underground mines to ensure balancing of the oxidizing components so that poisonous gases after an explosion are kept to a minimum. This is accomplished by ensuring an oxygen balance in the composition as prepared with the components uniformly dispersed throughout the mixture by the mixer.

Although preferred embodiments of the invention have been described herein in detail, it will be understood by those skilled in the art that variations may be made thereto without departing from the spirit of the invention or the scope of the appended claims.

The embodiments in which an exclusive property or privilege is claimed are defined as follows:

1. A method of mixing a batch of aqueous slurry explosive comprising mixing 100 parts by weight of components of said slurry explosive in a variable speed mixer which induces a forward and a reverse flow to said mixture in providing continuous shear blending of the mixture components, said method comprising mixing at a first speed in said mixer 10 to 20 parts by weight of ambient temperature water with 3 to 12 parts by weight of sugar and optionally up to 5 parts by weight of air bubble entraining agent other than paint fine aluminum, continue mixing at said first speed and adding 50 to 85 parts by weight of ground ammonium nitrate and increasing the mixing speed to a second speed in forming a slurry of ammonium nitrate, adding if needed up to 5 parts by weight of paint fine aluminum air bubble entraining agent in a plastic mesh binding to provide a total of said air bubble entraining agent up to approximately 6 parts by weight, adding a dispersion of 1 to 4 parts by weight of guar gums and 2 to 6 parts by weight of ethyleene glycol and continuing mixing at said higher second speed, reducing mixing speed to said first speed when complete distribution of components is achieved and continuing mixing at said first speed until the guar gum component is compeltely hydrated.

2. A method of claim 1, wherein said first speed is approximately 40 rpm and said second speed is approximately 80 rpm.

3. A method of claim 1, wherein said air bubble entraining agent is selected from the group consisting of milled aluminum, glass microspheres, plastic microsperes, borate microspheres and mixtures thereof.

* * * * *